US007124617B2

(12) United States Patent
Satterlee et al.

(10) Patent No.: US 7,124,617 B2
(45) Date of Patent: Oct. 24, 2006

(54) MAGNETIC DENT REMOVAL DEVICE, METHOD AND KIT

(76) Inventors: Eric Richard Satterlee, 5921 Buttonwood Dr., Haslett, MI (US) 48840; Wayne Tanabe, 101 N. Hickory, Arlington Heights, IL (US) 60004

( * ) Notice: Subject to any disclaimer, the term of this patent is extended or adjusted under 35 U.S.C. 154(b) by 104 days.

(21) Appl. No.: 10/341,611

(22) Filed: Jan. 14, 2003

(65) Prior Publication Data

US 2004/0134255 A1 Jul. 15, 2004

(51) Int. Cl.
*B21J 15/24* (2006.01)
*B21D 5/00* (2006.01)

(52) U.S. Cl. ..... 72/430; 72/466.6; 72/479; 72/705

(58) Field of Classification Search ..... 72/430, 72/457, 465.1, 466.6, 476, 478, 479, 481.3, 72/481.8, 705; 29/90.01
See application file for complete search history.

(56) References Cited

U.S. PATENT DOCUMENTS 4,727,745 A 3/1988 Ferree
4,754,637 A * 7/1988 O'Dell ..... 72/430
5,445,000 A * 8/1995 Brown ..... 72/31.01
5,800,106 A * 9/1998 Miller ..... 410/117
6,347,456 B1 * 2/2002 Jones et al. ..... 30/491
6,669,024 B1 * 12/2003 Ottens ..... 209/215
2002/0112516 A1 8/2002 Akins
2002/0112517 A1 8/2002 Akins

OTHER PUBLICATIONS

Magnetic Dent Removal System, www.magneticdentremovalsystem.com.*
Allied TechnicGab, napbirt.org.*
http://www.unitedmusical.com/CG_Conn/pdf/Dent_Eraser.pdf.
http://www.dingking.com.
http://techpartners.osu.edu/abstracts/99ID41.html.

* cited by examiner

*Primary Examiner*—Ed Tolan
(74) *Attorney, Agent, or Firm*—John M. Naber; Dickinson Wright PLLC

(57) ABSTRACT

A magnetic dent removal device (18), method and kit comprises a handle assembly (20) used with a burnishing element (24). The handle assembly (20) includes a handle (26), a containment cup (30) and a magnet (22) received within the containment cup (30). A magnet shield (40) is connected to the handle assembly (20), and a cover pad (38) can be attached to the magnet shield (40). A hooking element (64) can be attached to the handle assembly (20) to allow for the attachment of accessory components to aid in dent removal. An amplification bar (56) can be attached to the hooking element (64) to add strength to the magnetic force. A kit (74) for dent removal includes a carrying case (76), at least one handle (26), at least one magnet (22), at least one burnishing element (24) at least one cover pad (38), and at least one magnet shield (40).

20 Claims, 8 Drawing Sheets

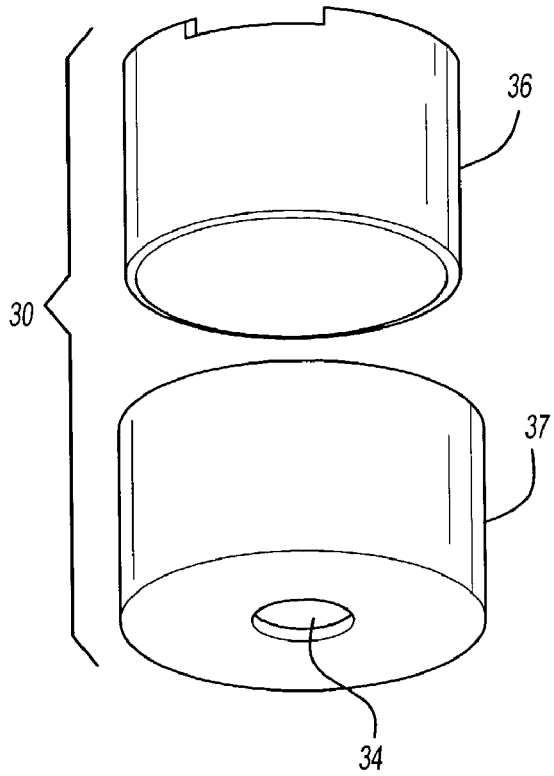
Fig-4
Fig-5
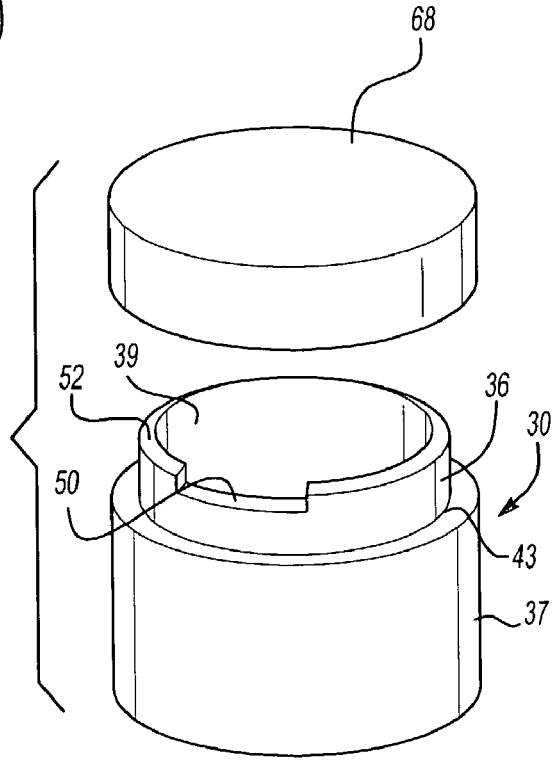
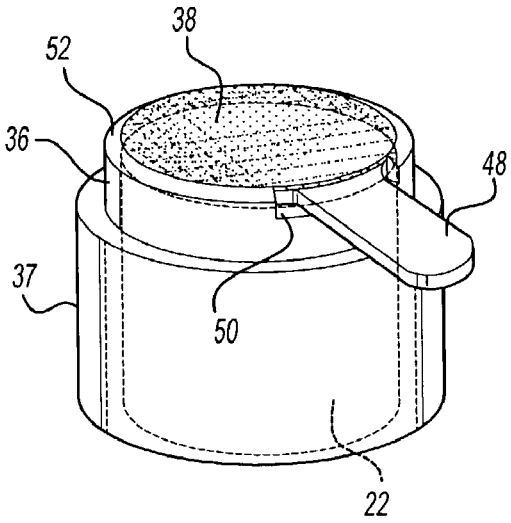
Fig-6B
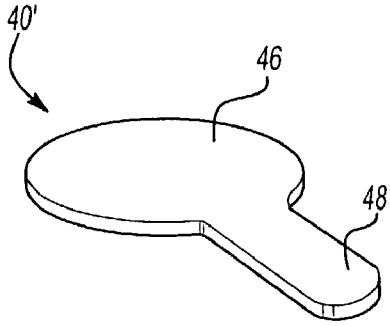
Fig-6A

MAGNETIC DENT REMOVAL DEVICE, METHOD AND KIT

TECHNICAL FIELD OF THE INVENTION

The present invention relates generally to dent removal and specifically to a device, method and kit suitable for removing dents from objects such as musical instruments.

BACKGROUND OF THE INVENTION

Dent removal in metallic surfaces and other malleable surfaces has been accomplished through a number of different methods in the past. Early methods involved use of a hammer type tool, where the dent is basically hammered out of the damaged metal material. This type of dent removal process can be very labor intensive and often involve disassembling the object being repaired. Another problem is that it can result in a surface that will need to be polished and finished due to the inability to completely smooth out the dents with a hammer type tool.

Another dent removal method specifically designed for removing dents from tubular components such as those found in musical instruments is disclosed in U.S. Pat. No. 4,727,745 to Ferree. This method involves the use of a barrel shaped "dent ball." The ball is forced through the tube needing repair, pushing out the dents as it travels through the tube. This type of dent removal system has several disadvantages such as being difficult to maneuver through curves in the tubing. Also, the dent ball may get lodged inside the tubing. This type of system is also inadequate for repairing dents in hard to reach locations due to the required space needed to operate the device within the object. It is also limited to the repair of tubing and would not be able to repair flat shaped objects or objects not having interior walls close enough to each other to benefit from the force of pushing or pulling the dent ball through the object.

Use of magnetic force for dent removal has been known for many years and initially involved using electromagnetic technology. The use of magnets helps reduce surface quality issues present with traditional hammer type systems and enables dent removal in hard to reach locations without needing to disassemble the object being repaired. Dent removal systems using rare earth magnets are also well known in the art and are also well suited for removing dents from non-magnetic materials such as brass, aluminum and stainless steel. These systems use a rare earth magnet magnetically connected to a steel handle used in conjunction with a steel ball. The steel ball is placed on one side of an object to be repaired and the magnet is placed on the other side of the object. The magnet is moved back and forth across the surface. As the steel ball is attracted to the magnetic pull, it burnishes out the dent in the object. A protective cover may be adhesively connected to the magnet and a handle sleeve may also be included.

Although such magnet dent removal systems provide some advantages over a traditional hammer type system and have been known for many years, several new features are possible. In addition, prior art systems have several shortcomings. First, the sleeve on the handle is often made from a plastic material that is primarily just a cover surface for the handle and magnet and does not actually protect the expensive and powerful magnet from damage. Broken magnet fragments can be razor sharp. Also dent removal systems known in the art do not provide an ergonomic grip for the user. Further, removing and reapplying a protective adhesive pad directly to a rare earth magnet can result in the eventual deterioration of the plated magnetic surface and thereafter deteriorate the finish and subsequent effectiveness of the magnet. There has also been to date no attempt to regulate the amount of magnetic force applied to an object.

Thus there is a desire and a need to add features to rare earth magnet based dent removal systems known in the art to address the aforementioned, as well as other deficiencies.

SUMMARY OF THE INVENTION

Accordingly, the present invention provides a dent removal device and method incorporating a rare earth magnet into a specially designed containment handle assembly. The device not only securely holds and protects the powerful magnet, but also eliminates surface finish damage and includes an ergonomically designed handle assembly for improved handling by the user.

In one embodiment of the present invention a device for use with a burnishing element to remove dents from the surface of an object includes a handle assembly including a containment cup having a lower cup element and a sleeve. A handle is connected to a bottom surface of the lower cup element and a magnet is received within the sleeve and connected to the handle on one end and has an opposite exposed end. A magnet shield is connected to the magnet or the containment cup covering the exposed end.

In another embodiment of the present invention, a device for use with a burnishing element to remove dents from the surface of an object includes a containment cup having a lower cup element and a sleeve. The lower cup element has an aperture on a bottom surface, and the sleeve defines an opening. A coupling element is positioned within the opening and a connecting block having one end configured to fit within the aperture on the bottom surface is connected to the coupling element. The block is held securely to the containment cup and has a second opposite end configured to be attached to a handle. A magnet is received within the opening and has one end magnetically connected to the coupling element and an opposite exposed end and a magnet shield is connected to the exposed end.

In yet another embodiment of the present invention a method of removing a dent from an object is provided using a dent removal device including a handle assembly and a burnishing element. The handle assembly includes a handle, a containment cup and a magnet positioned within the containment cup. The method comprises the steps of: attaching the containment cup to the handle; attaching a magnet shield to the handle assembly; positioning the burnishing element on one side of the object; positioning the handle assembly on the other side of the object and magnetically attracting the burnishing element to the handle assembly; and sliding the handle assembly back and forth across the surface of the object.

In still another embodiment of the present invention, a kit for removing a dent from an object is provided including at least one magnet, at least one handle, at least one containment cup, at least one burnishing element and at least one magnet shield.

Other features of the present invention will become more apparent to persons having ordinary skill in the art to which the present invention pertains from the following description and claims taken in conjunction with the accompanying figures.

BRIEF DESCRIPTION OF THE FIGURES

The foregoing features, as well as other features will become apparent with reference to the description and figures below, in which like numerals represent like elements, and in which:

FIG. 4 is a bottom perspective view of the containment cup of the present invention;

FIG. 5 is a perspective and exploded view of the containment cup and lid of the present invention;

FIG. 6A is a perspective view of an embodiment of a magnet shield of the present invention;

FIG. 6B is a perspective view of the containment cup and an embodiment of the magnet shield of the present invention;

DETAILED DESCRIPTION OF THE INVENTION

The present invention relates to a device suitable for use as a dent removal device and specifically to a device and method for removing dents from non-magnetic metals (such as band instruments), using magnetic force. Non-magnetic materials may include materials such as brass, stainless steel and aluminum.

Figure 1:
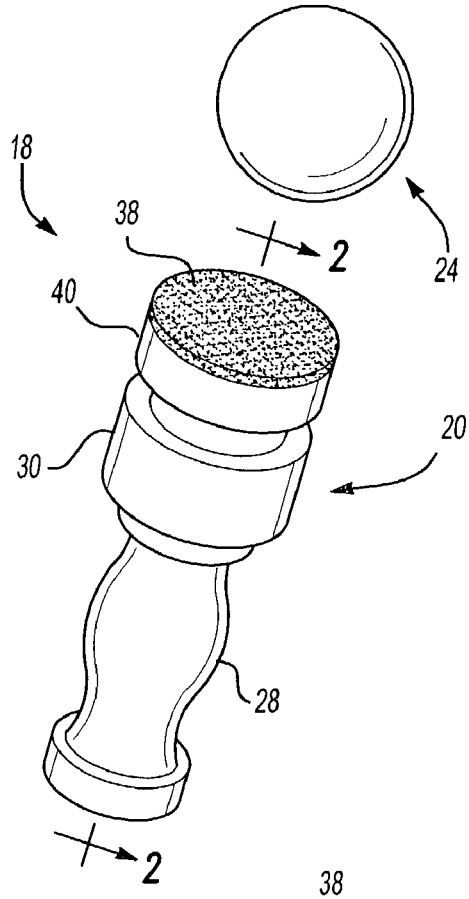
FIG. 1 is a perspective view of one embodiment of the present invention.
Figure 2:
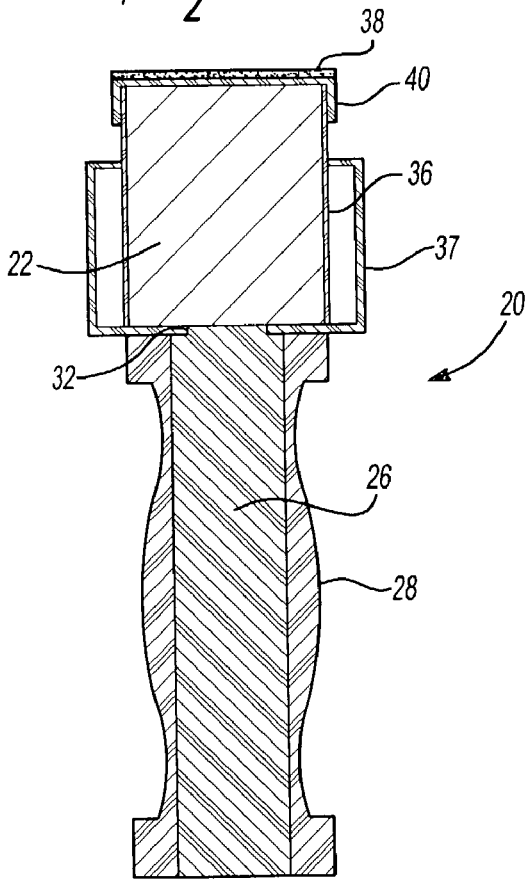
FIG. 2 is a sectional view taken along line 2—2 in FIG. 1.
Figure 3:
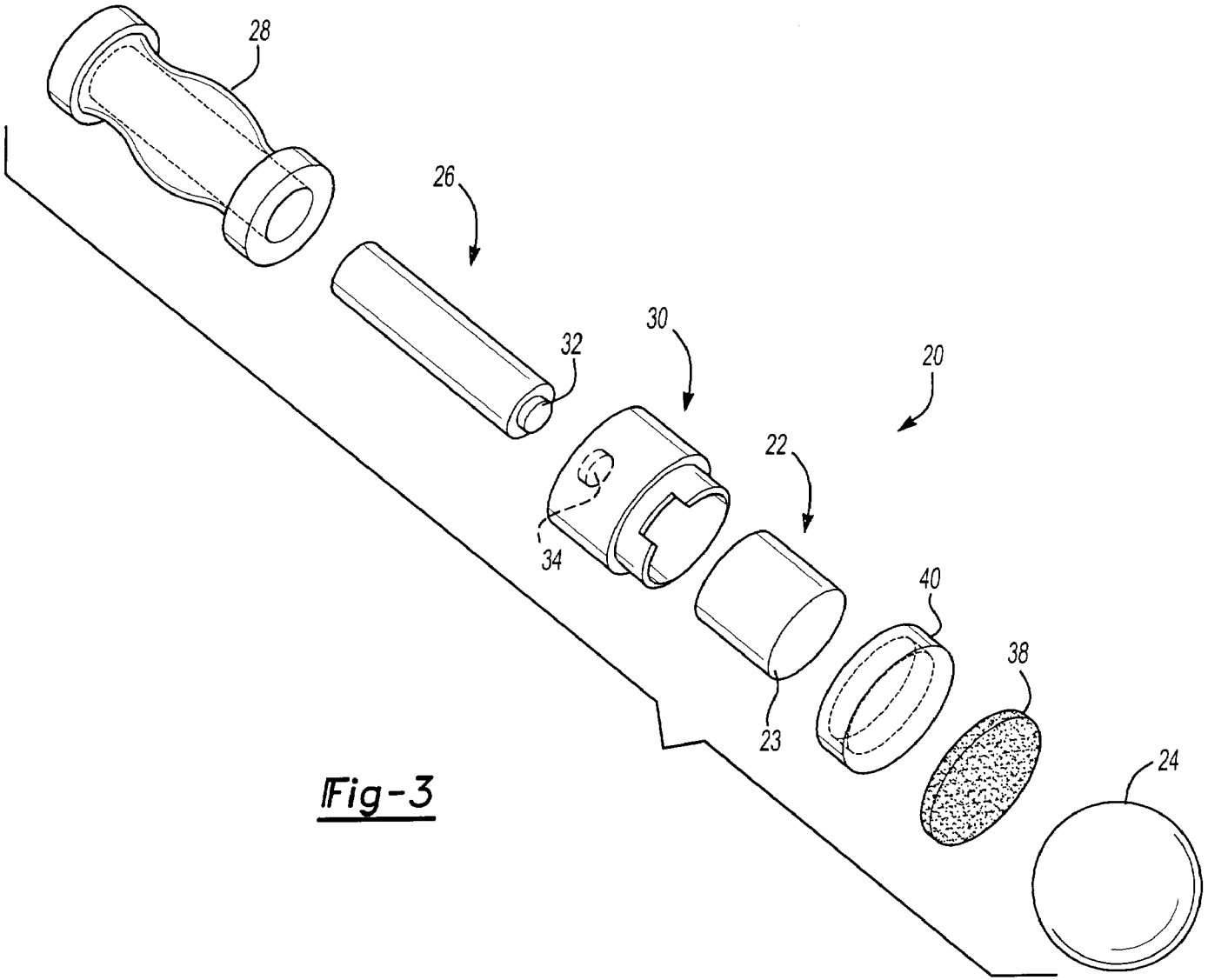
FIG. 3 is an exploded view of the embodiment of the present invention shown in FIG. 1.

Referring now to FIGS. 1, 2 and 3, one embodiment of the present invention generally indicated at 18 includes a handle assembly 20 and a burnishing element 24. The handle assembly 20 can include a handle 26, a handle grip 28, a containment cup 30, a magnet 22, and a magnet shield 40 having a cover pad 38 that may be attached thereon. Handle 26 may be made from steel or any other rigid material. In one embodiment, handle 26 is columnar shaped and includes a smaller diameter insertion end 32 configured to fit in an aperture 34 on a bottom surface of containment cup 30. Handle grip 28 is configured to fit tightly over an exterior surface of handle 26 to increase comfort to the user and provide better maneuverability of the tool during use. In this embodiment, handle grip 28 is made of a foam material, but it should be understood that handle grip 28 could also be constructed of any other suitable material such as rubber or fabric.

FIGS. 4 and 5 provide more detail of containment cup 30. Containment cup 30 includes a sleeve 36 having an interior surface 39 and configured to fit within a lower cup element 37. Interior surface 39 is configured to receive magnet 22. Sleeve 36 is positioned within lower cup element 37 so that a top exposed surface 23 (FIG. 3) of magnet 22 will be positioned just below a top edge 52 of sleeve 36. Once positioned within lower cup element 37, sleeve 36 can be adhesively glued in place to ensure that it does not slip out of position. This can be accomplished by running a bead of adhesive along a top portion 43 of lower cup element 37 where it contacts sleeve 36. Alternatively, sleeve 36 could be threadably attached to lower cup element 37, frictionally connected, snap fit connected or any other suitable connection scheme (not shown). In addition, containment cup 30 could be constructed as a unitary component incorporating lower cup element 37 and sleeve 36 into one piece.

As shown in FIG. 4, lower cup element 37 includes aperture 34 and insertion end 32 of handle 26 is inserted through aperture 34 and can be magnetically attracted to magnet 22 to hold magnet 22 securely within containment cup 30. Handle 26 also provides for increased strength to magnet 22. It is well known in the art that by adding a steel component to an end of a rare earth magnet, the magnetic flux or power can be increased. Containment cup 30 protects magnet 22 on all sides except on exposed surface 23 and can vary in size and shape depending on the size and shape of the magnet needed for a particular repair job.

In the embodiments of the present invention, the rare earth magnets 22 can be cylindrical shaped with, for example, a 1" (2.54 cm), 1.5" (3.81 cm) or 2" (5.08 cm) diameter and a 1" (2.54 cm), 1.5" (3.81 cm) or 2" (5.08 cm) length. Magnets 22 are available in various strengths such as an N35, N45 or N48 magnet that are known in the art, where the higher the number the greater the strength. The size and strength of magnet 22 required for a particular repair job will depend on characteristics of the object to be repaired, such as the size of the dent and the type of material to be repaired. Thus, any variety of sizes, shapes and strength of magnet 22 could be utilized.

Ideally, exposed surface 23 of magnet 22 should be covered to both protect exposed surface 23 and the surface of the object being repaired. Adhesives should not be applied directly to the surface of rare earth magnets therefore cover pad 38 should not be attached directly to the surface of magnet 22. To eliminate this problem, magnet shield 40 (FIGS. 1, 2, 3 & 6) can serve as a secondary surface for receiving cover pad 38. Magnet shield 40 protects magnet 22 from breakage or surface damage by covering exposed surface 23. Magnet shield 40 also serves to protect the surface of the object to be repaired from being scratched or damaged.

In one embodiment, magnet shield 40 can be releasably attached to containment cup 30, or alternatively magnet shield 40 can be releasably attached to exposed end 23 of magnet 22. Protective cover 38 can be adhesively attached to magnet shield 40. By using a detachable magnet shield 40, the contact surface between handle assembly 20 and the repair surface may be interchanged. For example, a user could have several magnet shields 40 having different types of cover pad 38 attached to thereon to allow the user to choose a desired surface for a given application. Cover pad 38 may also be removed and replaced on magnet shield 40 unlike if cover pad 38 were being attached directly to the surface of magnet 22. In the embodiment of magnet shield 40 shown in FIGS. 1, 2 and 3, magnet shield 40 is attached with a friction fit over sleeve 36 of containment cup 30, but other like attachment methods could also be used such as a threaded attachment or a snap fit (not shown). In this embodiment, magnet shield 40 can vary in diameter and length depending on the particular object being repaired and the magnetic force needed. Magnet shield 40, in this embodiment, may be constructed of plastic, steel or other suitable materials. When this embodiment of magnet shield 40 is attached to handle assembly 20, there is a gap created between magnet 22 and an inside top surface of magnet shield 40. By creating a gap between magnet 22 and the object to be repaired, the magnetic strength of magnet 22 can be reduced. In some circumstances it may be desirable to reduce the magnet strength for a given repair application. Magnet shield 40 can vary in length to create varying gap sizes. For example, if a shorter length magnet shield 40 is used the gap will be smaller and thus the magnet strength will not be affected as greatly. Magnet shield 40 can also have a domed outer surface to further aid in the gliding motion of magnet 22 over the surface to be repaired.

In another embodiment illustrated in FIGS. 6A and 6B, magnet shield 40' is substantially flat and paddle shaped having a plate portion 46 and a tab portion 48. Plate portion 46 is configured to fit on exposed end 23 of magnet 22 with tab portion 48 extending outwardly away from handle assembly 20 through a recessed opening 50 on sleeve 36 (FIGS. 4, 5 & 6B). Magnet shield 40' may be constructed of steel and is magnetically held in place on exposed surface 23 of magnet 22. Magnet shield 40' could also be constructed of other like materials capable of magnetically attaching to magnet 22. Magnet 22 is sized lengthwise for use in a particular size containment cup 30 such that exposed end 23 is slightly below the top edge 52 of sleeve 36 (approximately 0.030" (0.076 mm)). The thickness of magnet shield 40' is sized so that it fits on exposed end 23 and extends just beyond top edge 52. This reduces lateral movement of magnet shield 40' on magnet 22 during use. Recessed opening 50 further holds magnet shield 40' by trapping tab portion 48 side-to-side preventing magnet shield 40' from rotating during use. Tab portion 48 also aids in removal of magnet shield 40' from magnet 22 by providing a tab for the user to pull. Unlike magnet shield 40, magnet shield 40' does not affect the magnet strength because it is connected directly to exposed surface 23 of magnet 22 rather than providing a gap as does magnet shield 40.

In another embodiment, magnet shield 40" is disc-shaped and includes a domed surface that is hard chrome plated (FIGS. 9–14). Disc shaped magnet shield 40" is magnetically attached to magnet 22 in the same manner as paddle shaped magnet shield 40'. The hard chrome plating allows this embodiment of magnet shield 40" to be used without adding cover pad 38. The hard chrome plated surface of the disc-shaped magnet shield 40" can glide over the surface to be repaired without damaging that surface or causing damage to itself. In this embodiment, the domed shape provides additional maneuverability for the user by enabling the tool to be rolled in areas where the surface being repaired is radiused. However, with this embodiment, once the disc-shaped magnet shield 40" is magnetically attached to magnet 22, it is very difficult to remove because there is no tab portion 48 as in magnet shield 40'. It is therefore effectively a permanent part of the tool. Furthermore, when disc-shaped magnet shield 40" is used, it is not necessary for sleeve 36 to include recessed opening 50 since there is no tab portion 48 in this embodiment.

As stated above, magnet shield 40 or 40' can adhesively receive cover pad 38. Cover pad 38 may be made of material such as VELCRO, TEFLON, UHMW, felt, nylon or any other like material suitable for protecting the surfaces from scratches and at the same time providing a frictionless contact between handle assembly 20 and the surface to be repaired. Another way to protect the surface of the object to be repaired is to place a clear material on the object to be repaired as opposed to on the magnet shield 40 or 40'. For this type of surface protection, materials such as clear drum material, burnishing tape, Ultra Suede, bicycle inner tube rubber and various other materials can be used. It is also recommended to lubricate the surface to be repaired prior to using the magnetic dent removal system. Lubrication of the surface will aid in the sliding motion of handle assembly 20 against the surface of the object to be repaired. Wax sprays such as furniture polish can be used as the lubricant. Lanolin and various forms of slide grease can also be used as lubrication, however the clean up is much more difficult.

The present invention may also include a lid 68 to cover exposed end 23 of magnet 22 when not in use and when no magnet shield 40 is attached to handle assembly 20 (FIG. 5). Lid 68 can fit over sleeve 36 of containment cup 30 similar to how magnet shield 40 is attached except lid 68 completely covers sleeve 36. A friction-fit attachment may be used to releasably attach lid 68 to sleeve 36, but other attachment methods can be used such as a threaded or snap fit attachment.

A burnishing element 24 is used in conjunction with handle assembly 20 to accomplish the dent removal from an object. In one embodiment, burnishing element 24 is spherical shaped and is made of steel (a steel ball as shown in the figures). However, burnishing element 24 could be many other shapes and sizes depending on the object to be repaired and can be made from any other type of material capable of magnetic attraction to magnet 22. Just as the tensile strength of the material to be repaired, and the size and strength of the rare earth magnet is important, the type and size of burnishing element 24 must also be considered. For example, in the case of a spherical steel ball, both hollow and solid balls can be effective as burnishing element 24 depending on the desired results and situation. Hollow balls are much lighter in weight and come in a variety of conventional sizes that may not be available with solid steel balls. Solid steel balls usually perform better than hollow balls in some applications due to their higher weight, and come in some sizes not available in the hollow steel balls. Generally, a larger burnishing element 24 would be desired to repair a large dent due to its greater weight and greater magnetic attraction. However, in some cases a large burnishing element 24 may not physically fit in the object to be repaired so a smaller ball or balls may have to be used. Thus, it depends on the particular object to be repaired when selecting the size and type of burnishing element 24 to be used.

In addition to the primary components described above, the present invention can include several other optional features to optimize performance for a given situation. An amplification bar 56 can be added lengthwise to the handle assembly to further increase the strength of magnet 22. It is known in the art that by adding a magnetically attracted component to a magnet, the magnetic strength can be increased. For example, as illustrated in FIGS. 7 & 8, handle 26 of handle assembly 20 can include a tapped aperture 58 (such as a ¼-20 thread) on an end opposite insertion end 32.

Amplification bar 56 can include a mating threaded screw 60, which threadably attaches amplification bar 56 to handle 26. Alternatively, threaded screw 60 could be connected to handle 26 and the mating tapped aperture 58 could be on amplification bar 56.

Figure 7:
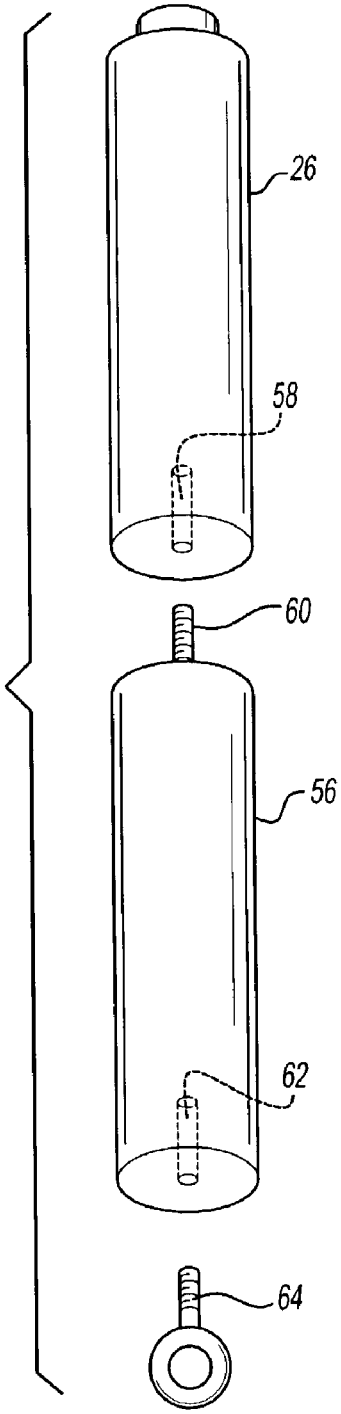
FIG. 7 is an exploded view of the handle, amplification bar and hooking element of the present invention.
Figure 8:
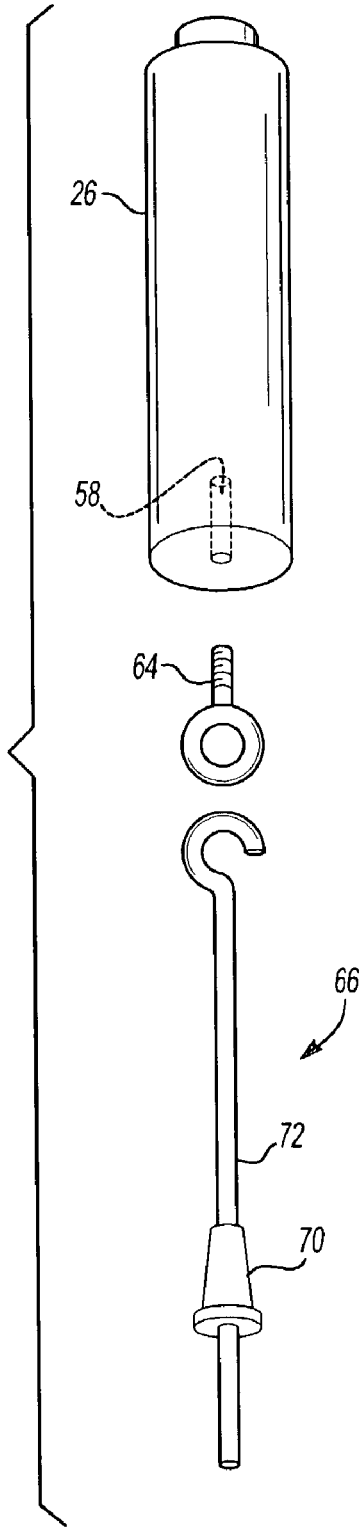
FIG. 8 is an exploded view of the handle, hooking element and slide mechanism of the present invention.

For illustrative purposes, tapped aperture 58 is shown on handle 26 in FIGS. 7 & 8. Amplification bar 56 can also include a tapped aperture 62 on an opposite end of amplification bar 56 for threadably receiving a hooking element 64 such as an eyebolt, or for connection of an additional amplification bar 56. Multiple amplification bars 56 can be added to the handle assembly 20 to increase the magnet strength as required for a particular application. Hooking element 64 could also be attached directly to handle 26 in tapped aperture 58 instead of amplification bar 56. Hooking element 64 can be used for storing the tool by hanging hooking element 64 on a storage hook and can also be used to releasably connect a slide mechanism 66, such as a slide hammer tool known in the art, that can be used to assist in pulling the dent out of the object to be repaired. This "pulling out" action is similar to the pulling action done to remove dents in auto body shops, and can be used to pull out difficult dents. Slide mechanism 66 has a slidably connected slider 70 that the user slides along a rod 72 in a jerking motion described below to provide the pull force necessary to pull out difficult dents. Slide mechanism 66 can also include a threaded screw instead of a hook end (not shown) to enable it to be threadably attached directly to tapped aperture 58 in handle 26 or tapped aperture 62 on amplification bar 56 in the same manner amplification bar 56 and hooking element 64 are connected.

Figure 9:
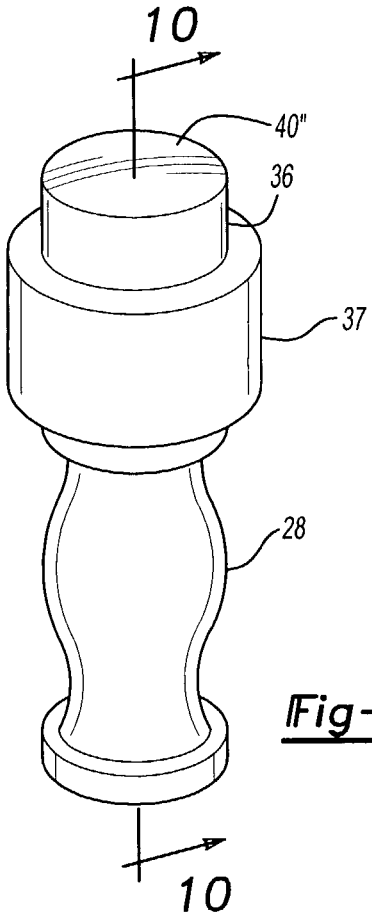
FIG. 9 is an assembled perspective view of one embodiment of the present invention.
Figure 10:
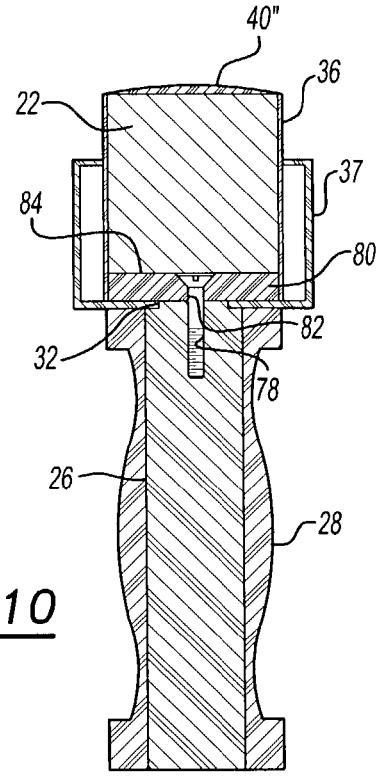
FIG. 10 is a sectional view taken along line 10—10 in FIG. 9.
Figure 11:
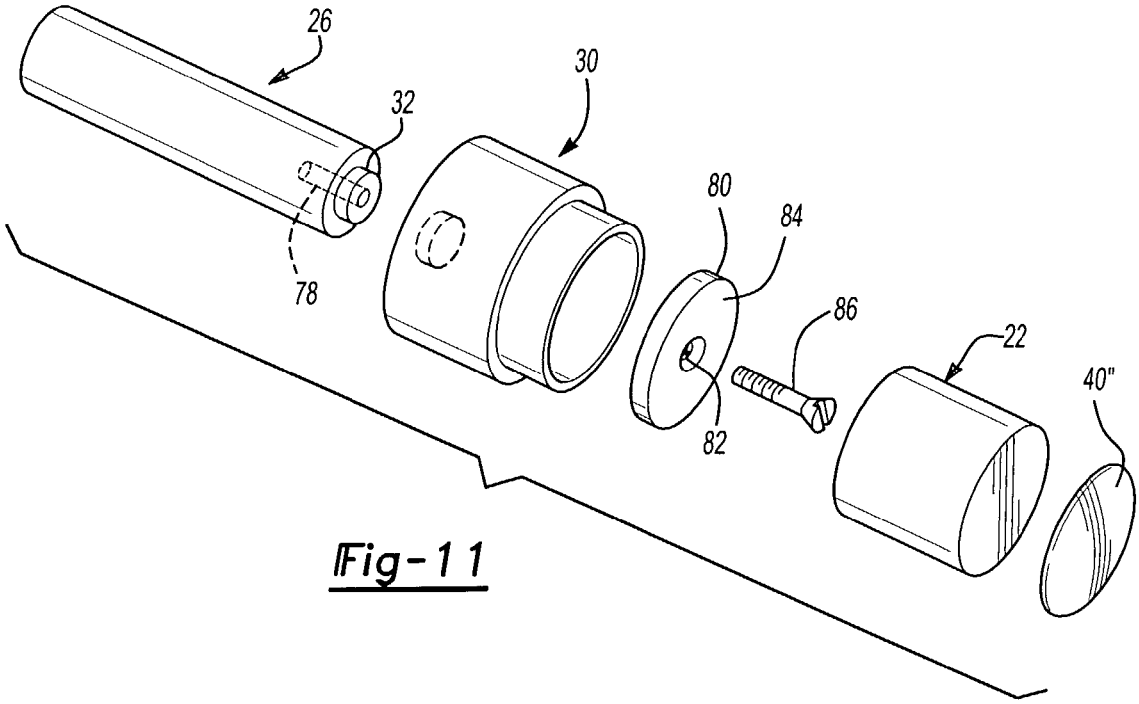
FIG. 11 is an exploded view of the embodiment of the present invention shown in FIG. 9.

In another embodiment of the present invention illustrated in FIGS. 9–11, handle 26 can include a second tapped aperture 78 on insertion end 32. In this embodiment, a steel coupling disc 80 having a hole 82 countersunk on a top side 84, can be used to connect handle 26 to containment cup 30. Coupling disc 80 is made of steel but could also be made of any other rigid material capable of magnetic attraction. Insertion end 32 is inserted into aperture 34 in lower cup element 37 and coupling disc 80 is then placed inside lower cup element 37. A threaded flat head screw 86 can be inserted into hole 82 of coupling disc 80 and threaded into second aperture 78 of handle 26. Insertion end 32 is sized lengthwise slightly longer than the thickness of containment cup assembly 30 so that as screw 86 is tightened it tightly connects a bottom surface of containment cup 30 to handle 26. Magnet 22 is then positioned inside containment cup 30 as in the previous embodiment and is magnetically held to coupling disc 80. Coupling disc 80 provides for greater increased strength to magnet 22 than in the previous embodiment. In the previous embodiment, because the diameter of handle 26 is significantly smaller than the diameter of the magnet 26 the full capacity of increased strength of the magnetic flux cannot be achieved. This is because the portion of the end of magnet 22 not contacting handle 26 does not transfer increased magnetic flux to handle 26. Because coupling disc 80 is approximately the same diameter as magnet 22 that will be included in a particular configuration, it is able to capture substantially more of the magnetic flux and channel it through handle 26.

Figure 12:
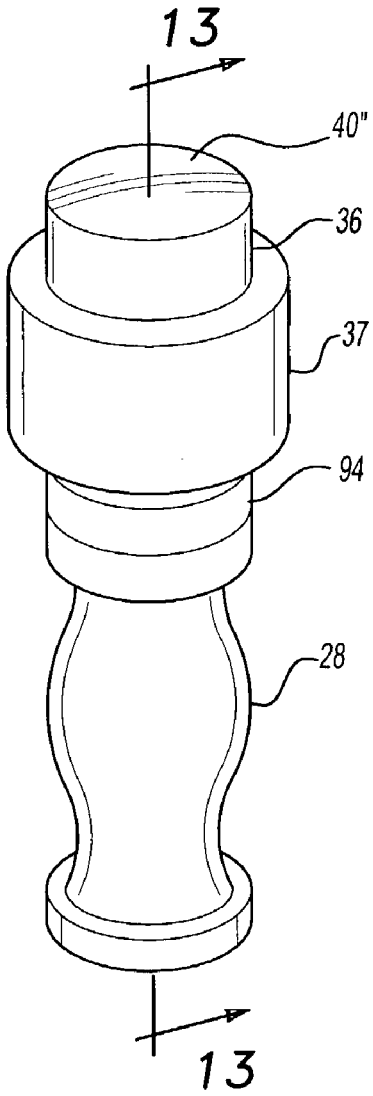
FIG. 12 is an assembled side view of an embodiment of the present invention.
Figure 13:
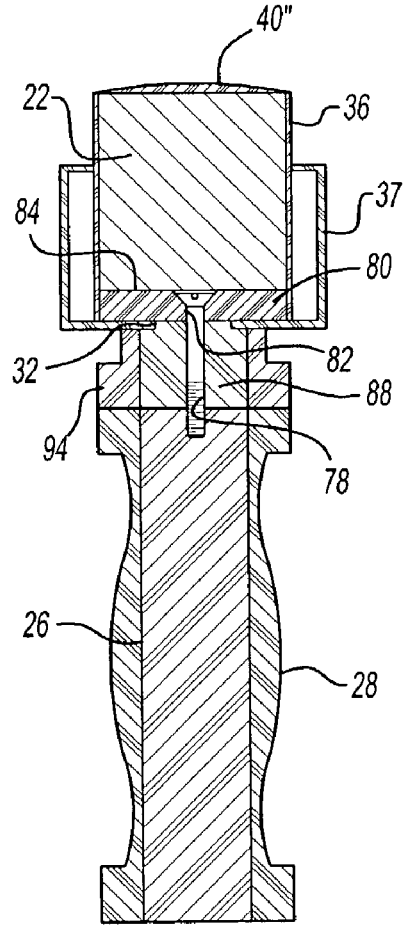
FIG. 13 is a sectional view taken along line 13—13 in FIG. 12.
Figure 14:
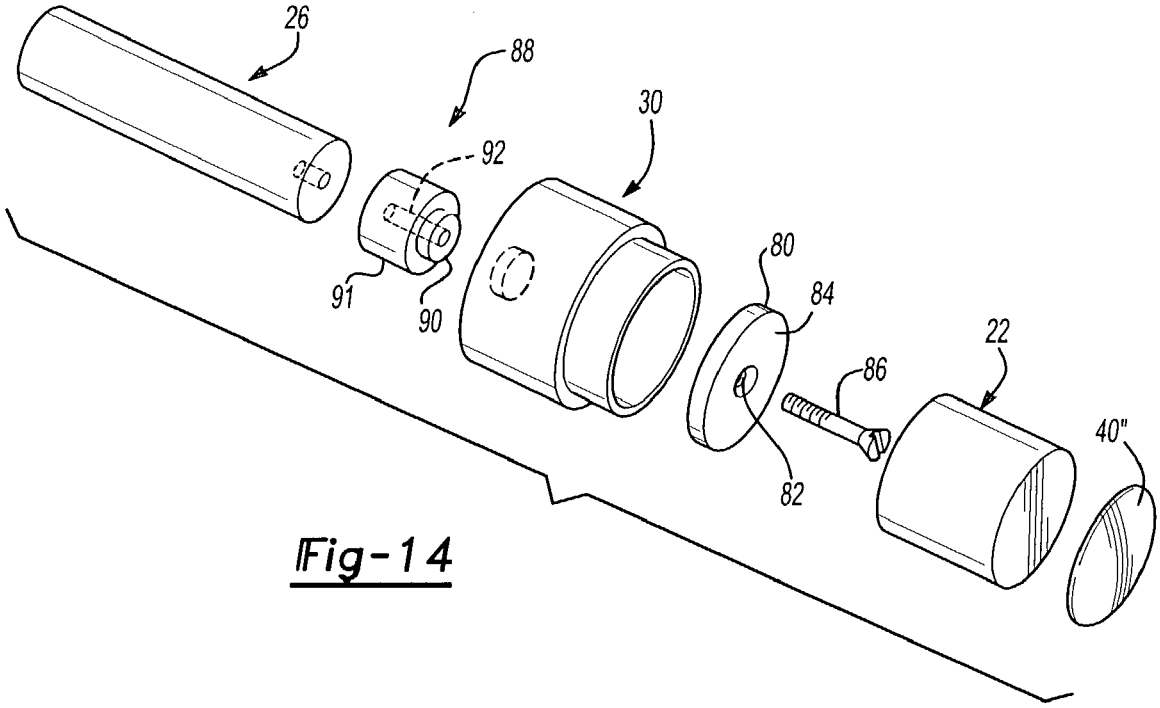
FIG. 14 is an exploded view of the embodiment of the present invention shown in FIG. 12.

Instead of connecting handle 26 to containment cup 30 directly with screw 86, a connecting block 88 can be included as shown in FIGS. 12–14. Connecting block 88 includes an insertion end 90, a base end 91, and a threaded aperture 92. Connecting block 88 can be connected to containment cup 30 in the same manner as handle 26 is connected. Screw 86 is sized long enough to permit it to be threaded through and extend sufficiently beyond connecting block 88, allowing for threaded connection of connecting block 88 to handle 26. By adding connecting block 88, containment cup 30 of this embodiment can be fully assembled including the magnet 22 and then be attached to any handle of the invention a user may already have. In the previous embodiment, because magnet 22 is held in position by the magnetic attraction between magnet 22 and handle 26, a fully assembled containment cup including the magnet 22 cannot be achieved without handle 26. Whereas in this alternate embodiment, coupling disc 80 holds magnet 22 in position within containment cup 30 allowing for the ability to assemble the magnet within the containment cup without the need of the handle to hold it in place.

Figure 15:
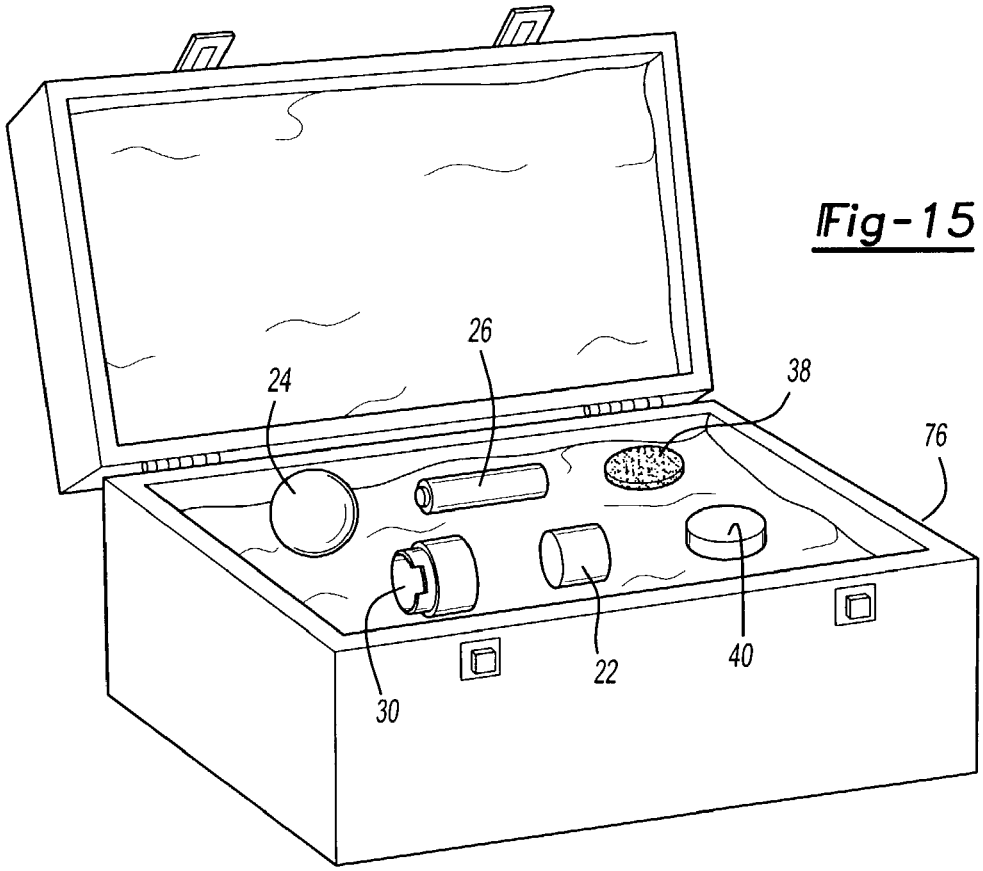
FIG. 15 is a perspective view of one embodiment of a kit of the present invention.

The elements described above can be combined in a kit 74 for use by a repairperson as illustrated in FIG. 15. The kit may include a carrying case 76 and can include any combination of the elements described in the present invention, but at a minimum should include at least one handle 26, at least one containment cup 30, at least one magnet 22, at least one burnishing element 24, at least one magnet shield 40 and at least one cover pad 38. Ideally the kit would include multiple burnishing elements 24 ranging in size from 1.375" (3.49 cm) to 5" (12.7 cm) in 0.125" (0.31 cm) increments to obtain the most versatility of the kit. In addition the kit could include various sizes of magnet 22 with corresponding containment cup assemblies 30, various sizes of magnet shield 40, 40' and 40", and numerous cover pads 38 made from various materials. Other add on accessory features may include at least one handle grip 28, at least one amplification bar 56, at least one hooking element 64, a slide mechanism 66 and a lid 68 to mate with containment cup assembly 30.

Figure 16:
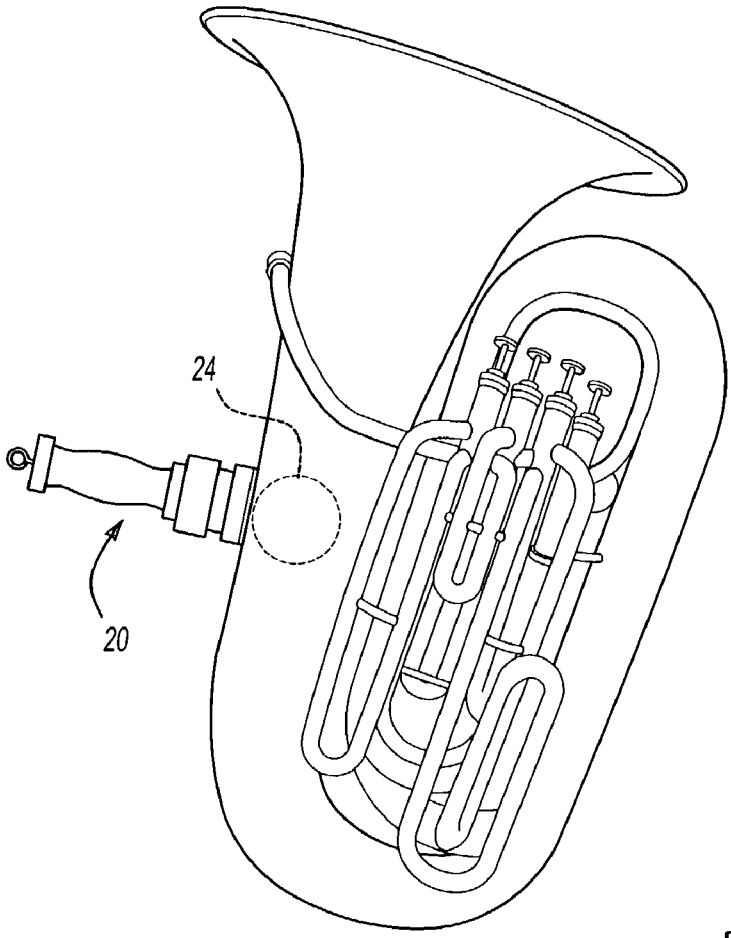
FIG. 16 is a perspective view of one embodiment of the present invention illustrating an in use position to repair a musical instrument.
Figure 17:
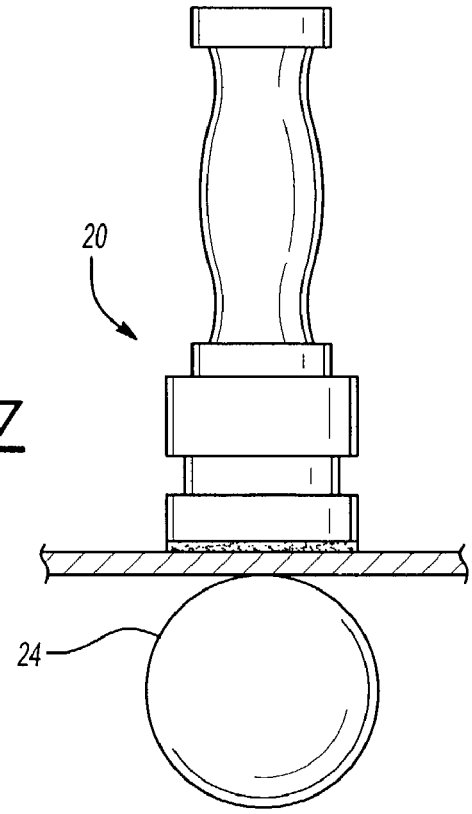
FIG. 17 is a perspective view of one embodiment of the present invention illustrating an in use position to repair an object.

In all of the described embodiments of the present invention their method of use is similar. In use, magnet 22 attracts burnishing element 24 that is drawn along the inner surface of an object or piece of material to be repaired. For example, FIG. 16 shows the invention being used to remove dents by placing burnishing element 24 inside the tubing of a brass musical instrument. FIG. 17 shows the invention being used to remove dents from a substantially flat object. Burnishing element 24 is positioned directly beneath magnet 22, which is being held by the user on the exterior surface of the object to be repaired. Magnet 22 and burnishing element 24 are positioned in the area of the dent to be repaired. Burnishing element 24 rolls inside the tubing simultaneously with being held firmly by the force of magnet 22, sandwiching the object being repaired between magnet 22 and burnishing element 24. Magnet 22 is drawn back and forth across the exterior of the object being repaired and burnishing element 24 (underneath magnet 22 or inside an object) burnishes out the dent(s) as it is forced to roll along the interior surface of the object by magnet 22.

In one variation of the method to practice the dent removal system of the present invention, magnet 22 is placed on the exterior surface of an object to be repaired such as a musical instrument and burnishing element 24 is placed inside. The instrument is then positioned so that burnishing element 24 is allowed to accelerate towards magnet 22 on the interior surface of the instrument. When burnishing element 24 collides with the instrument's interior wall, a hammering action occurs. Repetition of this action will eventually lift out otherwise stubborn dents.

Another variation of the method to practice the present invention involves the use of multiple burnishing elements 24. For instance, in some applications because of the small size of the tubing that needs repair, the size of the burnishing element 24 may be limited to be no greater than, for example, a 1.5" (3.81 cm) diameter spherical ball. The magnetic pull in this smaller size ball may be less than what is required to remove the dent because of its smaller mass and surface area. Therefore, by using two or more balls together, the overall mass can be increased providing greater magnetic pull to the tool. Overall, a user must also consider several factors governing the effectiveness of dent removal with the use of magnets that must be considered such as the thickness of the material to be repaired, tensile strength of the material, whether the material to be repaired has been work hardened, the type of dent, and the tubing strength.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A dent removing device for use with a burnishing element, comprising: a handle assembly including a containment cup having a lower cup element and a sleeve, a handle connected to a bottom surface of said lower cup element, a magnet received within and disposed slightly below a top edge of said sleeve and connected to said handle on one end and having an opposite exposed end, and a magnet shield magnetically connected to one of said magnet and said containment cup covering said exposed end.

2. The device of claim 1, further including a burnishing element positioned adjacent said containment cup opposite said handle, wherein said burnishing element is magnetically attracted to said handle assembly.

3. The device of claim 1 further including a cover pad attached to said magnet shield.

4. The device of claim 1, further including a hooking element threadably attached to said handle opposite said containment cup.

5. The device of claim 1, further including an amplification bar connected to said handle opposite said containment cup.

6. The device of claim 1, further including a handle grip configured to slide over an exterior surface of said handle.

7. The device of claim 1, wherein said magnet shield is made of plastic.

8. The device of claim 1, wherein said magnet shield is detachably connected to said handle assembly.

9. The device of claim 1, wherein said magnet shield is connected to said handle assembly by a friction fit connection.

10. The device of claim 1, wherein said magnet shield includes a domed surface.

11. The device of claim 1, further including a coupling element received within said containment cup and threadably connecting said handle to said containment cup.

12. The device of claim 1, wherein said burnishing element is made of steel.

13. The device of claim 1, wherein said burnishing element is spherical shaped.

14. A device for use with a burnishing element to remove dents from the surface of an object comprising: a containment cup having a lower cup element and a sleeve, said lower cup element having an aperture on a bottom surface, and said sleeve defining an opening; a coupling element positioned within said opening; a connecting block having one end configured to fit within said aperture on said bottom surface and connected to said coupling element such that said block is held securely to said containment cup, said block having a second opposite end configured to be attached to a handle; a magnet received within and disposed slightly below a top edge of said opening and having one end magnetically connected to said coupling element and an opposite exposed end; and a magnet shield magnetically connected to said exposed end.

15. A method of removing a dent from an object using a device including a handle assembly and a burnishing element, the handle assembly comprising a handle, a containment cup and a magnet positioned within and disposed slightly below a top edge of the containment cup, the method comprising the steps of: attaching the containment cup to the handle; attaching magnetically a magnet shield to the handle assembly; positioning the burnishing element on one side of the object; positioning the handle assembly on the other side of the object for magnetically attracting the burnishing element to the handle assembly; and moving the handle assembly back and forth across the surface of the object.

16. The method of claim 15, further including the step of attaching a cover pad to the magnet shield.

17. The method of claim 15, further including the step of connecting a hooking element to the handle assembly.

18. The method of claim 15, further including the step of attaching amplification bar to the handle assembly.

19. The method of claim 17, wherein the device further includes a slide mechanism having a slider element and a rod and further including the steps of: connecting the slide mechanism to the hooking element; and sliding the slider element back and forth along the rod.

20. The method of claim 15, further including the step of lubricating the surface.

* * * * *